US007556212B1

(12) United States Patent
Huang

(10) Patent No.: US 7,556,212 B1
(45) Date of Patent: Jul. 7, 2009

(54) AUTO ELECTRICITY BREAKER FOR SHREDDERS

(75) Inventor: Simon Huang, SanChung (TW)

(73) Assignee: Michilin Prosperity Co., Ltd., San Chung, Taipei Hsien (TW)

( * ) Notice: Subject to any disclaimer, the term of this patent is extended or adjusted under 35 U.S.C. 154(b) by 0 days.

(21) Appl. No.: 12/081,258

(22) Filed: Apr. 14, 2008

(51) Int. Cl.
*B02C 18/06* (2006.01)
*B02C 18/24* (2006.01)

(52) U.S. Cl. ..... 241/33; 241/36; 241/37.5

(58) Field of Classification Search ..... 241/33, 241/36, 37.5
See application file for complete search history.

(56) References Cited

U.S. PATENT DOCUMENTS 6,116,528 A * 9/2000 Schwelling ..... 241/36
6,964,386 B2 * 11/2005 Ho ..... 241/236
7,414,212 B2 * 8/2008 Huang ..... 200/334
2008/0164349 A1 * 7/2008 Wang ..... 241/30

* cited by examiner

*Primary Examiner*—Ramon M Barrera
(74) *Attorney, Agent, or Firm*—Bacon & Thomas, PLLC

(57) ABSTRACT

An auto electricity breaker includes a breaker switch, an energy storage device driven by a cutting blade ensemble, a variable gear set driven by the energy storage device, a trigger driven by the variable gear set to turn on the breaker switch, and a starting switch for restoring the trigger. The energy storage device stores energy concurrently during the operation of the cutting blade ensemble. When the cutting blade ensemble stops operation, the variable gear set is driven to operate. When the variable gear set operates to a certain extent, the trigger takes action to turn on the breaker switch. The breaker switch breaks the electrical power of the shredder to stop its operation. The user can turn on the starting switch for restoring the trigger and thus turn on the power of the shredder again for normal operation. The breaker then resumes its auto electricity breaker function.

8 Claims, 9 Drawing Sheets

AUTO ELECTRICITY BREAKER FOR SHREDDERS

BACKGROUND OF THE INVENTION

1. Field of Invention

The invention relates to a safety breaker for shredders and, in particular, to an electricity breaker that automatically shuts down the power of a shredder when its cutting blade ensemble stops operation for some time in order to save energy and provide protection.

2. Related Art

To prevent confidential files or data from being released to irrelevant people, they are usually destroyed by shredders. Therefore, the shredder has become an indispensable device in business and home life.

The action principle of most well-known shredders for shredding paper is to utilize several cutting blades along with spacers installed on two parallel rotary shafts that are driven by a motor and a gear box to rotate in opposite directions. A shearing force thus imposes on passing paper and cuts it into thin stripes. According to the mechanical cutting modes, shredders are divided into two types: stripe-cut shredders and cross-cut shredders. In the former case, the cutting blades are disposed regularly on the rotary shafts and cut the paper along the longitudinal direction into long stripes. Each blade on the latter has several hook-shaped cutting edge. The blades are disposed in a spiral way on the rotary shafts. In this case, the paper is not only cut along the longitudinal direction into stripes, but also cut in the transverse direction into chips.

The above-mentioned stripe-cut or cross-cut shredder basically comprises a cutting blade ensemble and relevant components. During the operation of the cutting blade ensemble, paper passing through the rotary shafts is shredded into tiny stripes or chips. The housing of the shredder is usually provided with a sliding switch (power switch) for switching among the auto, rev, or off mode. However, when the sliding switch is in the auto mode, the control circuit inside the shredder is still on even no paper is fed into the cutting blade ensemble. This causes unnecessary waste of electricity. Moreover, sensors can be mis-triggered to result in danger.

SUMMARY OF THE INVENTION

An objective of the invention is to provide an electricity breaker that automatically turn off the power of the shredder after the cutting blade ensemble stops operation for some time to achieve energy-saving and protection functions.

To achieve the above objective, the disclosed auto electricity breaker includes a breaker switch that controls the power of the shredder, an energy storage device driven by a cutting blade ensemble, a variable gear set driven by the energy storage device, a trigger driven by the variable gear set to turn on the breaker switch, and a starting switch for restoring the trigger. The energy storage device stores energy concurrently during the operation of the cutting blade ensemble. When the cutting blade ensemble stops operation, the variable gear set is driven to operate. When the variable gear set operates to a certain extent, the trigger takes action to turn on the breaker switch. The breaker switch breaks the electrical power of the shredder to stop its operation. Therefore, it saves energy and provides protection.

The user can turn on the starting switch for restoring the trigger and thus turn on the power of the shredder again for normal operation. The breaker then resumes its auto electricity breaker function.

BRIEF DESCRIPTION OF THE DRAWINGS

The invention will become more fully understood from the detailed description given herein below illustration only, and thus is not limitative of the present invention, and wherein:

FIG. 5 is a schematic view showing the state that the power of the invention is on;

DETAILED DESCRIPTION OF THE INVENTION

The present invention will be apparent from the following detailed description, which proceeds with reference to the accompanying drawings, wherein the same references relate to the same elements.

Figure 1:
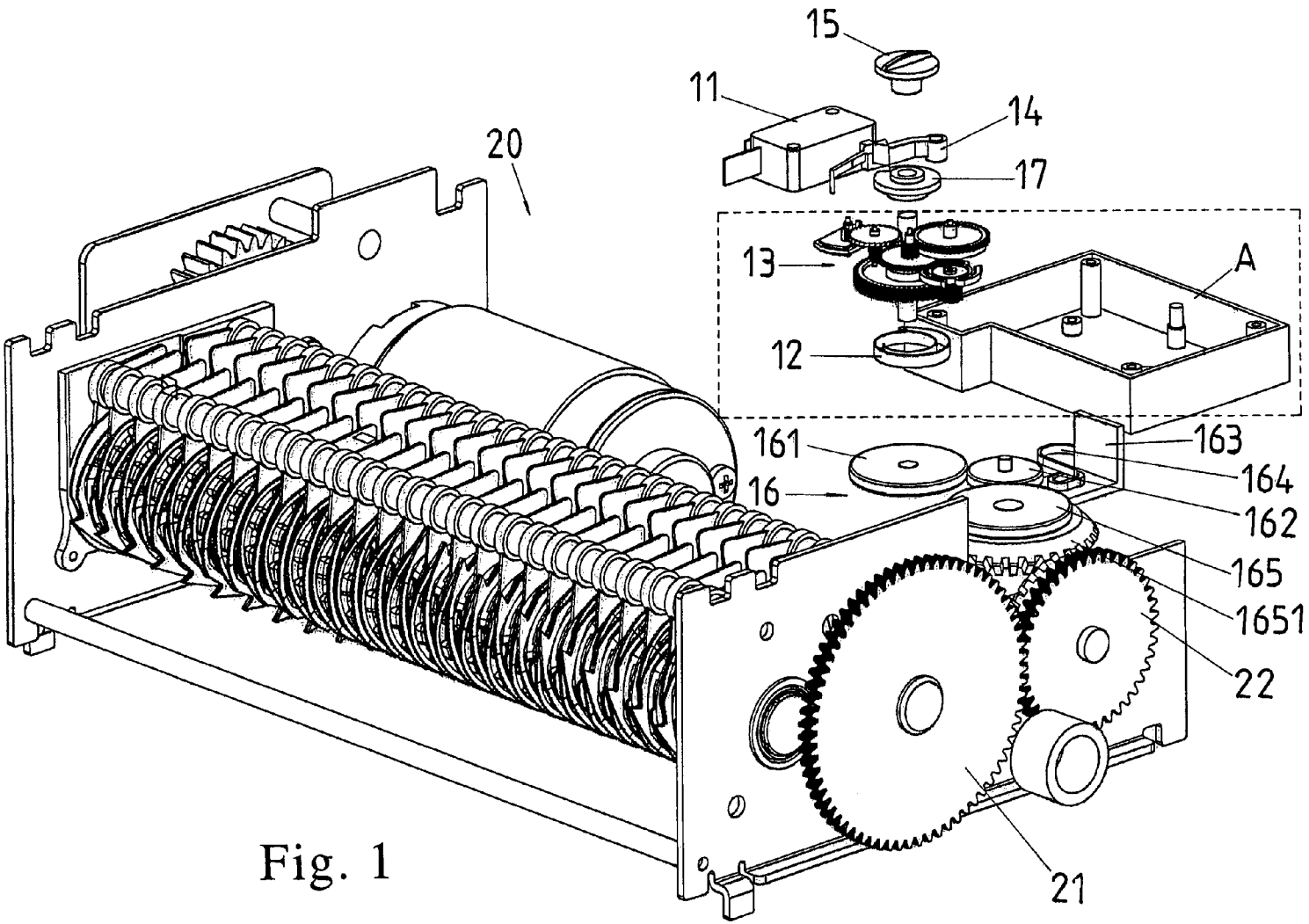
FIG. 1 is an exploded view of the disclosed auto electricity breaker.
Figure 2:
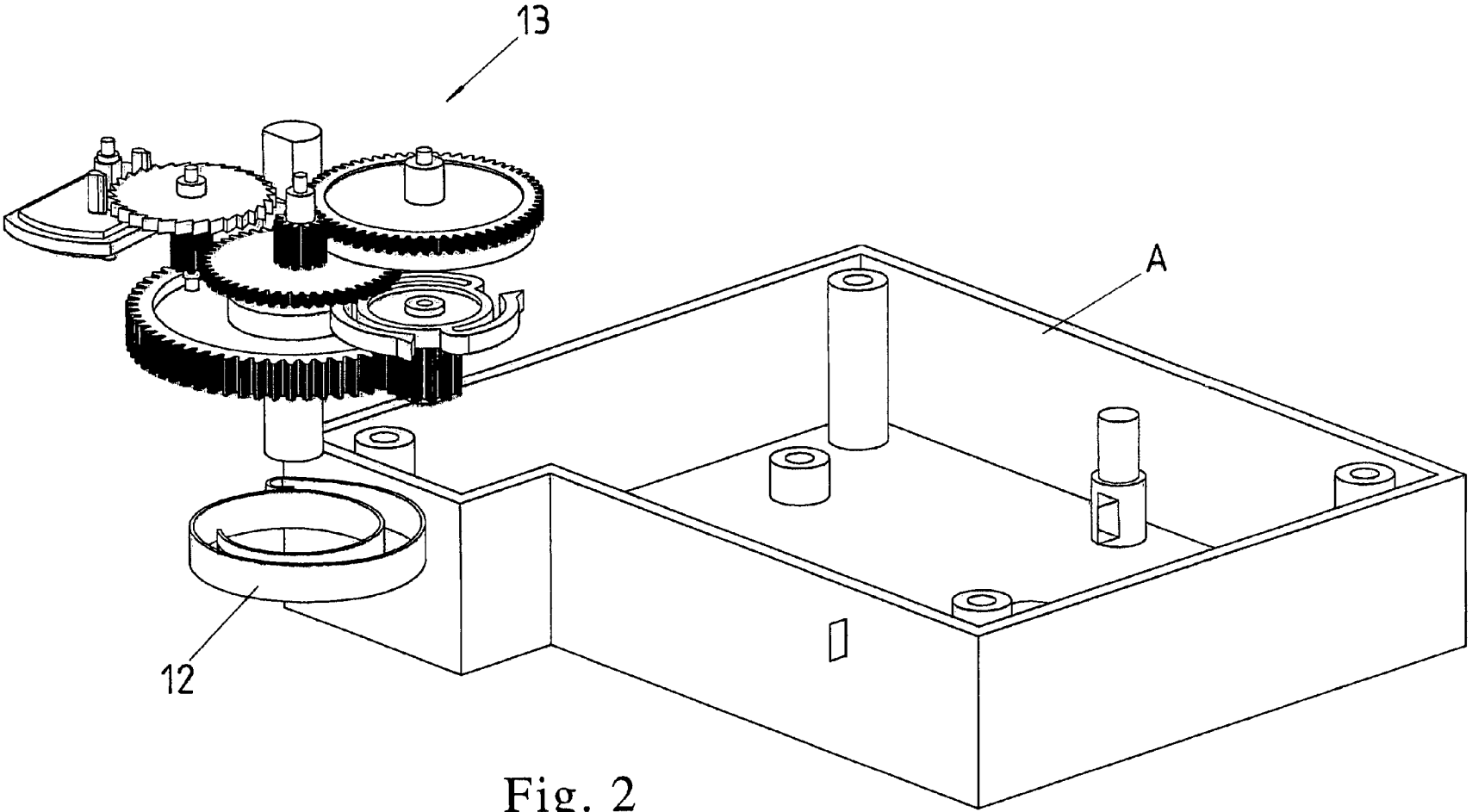
FIG. 2 shows the structure of the disclosed variable gear set.
Figure 3:
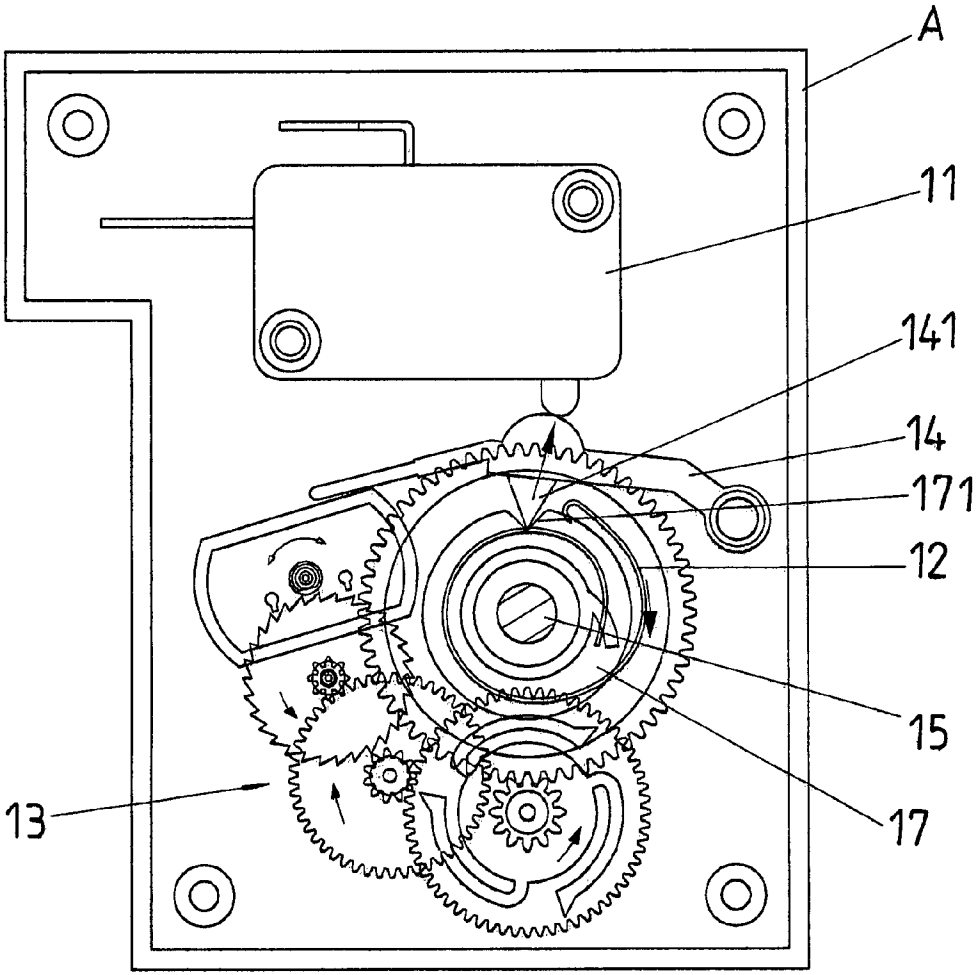
FIG. 3 is a planar view of the disclosed auto electricity breaker.

As shown in FIGS. 1, 2, and 3, the disclosed auto electricity breaker for shredders includes: a breaker switch 11, an energy storage device 12, a variable gear set 13, a trigger 14, a starting switch and a base A.

The base A is provided for the installation of relevant components of the auto electricity breaker. The breaker switch 11 controls the power supply to the shredder. The energy storage device 12 is driven by the cutting blade ensemble 20 of the shredder to store energy. The variable gear set 13 receives the energy released by the energy stroage device 12 and rotates. The trigger 14 is driven by the variable gear set 13 to turn on the breaker switch 11. The starting switch can be a knob 15, as shown in the drawing, for restoring the trigger 14.

Figure 5:
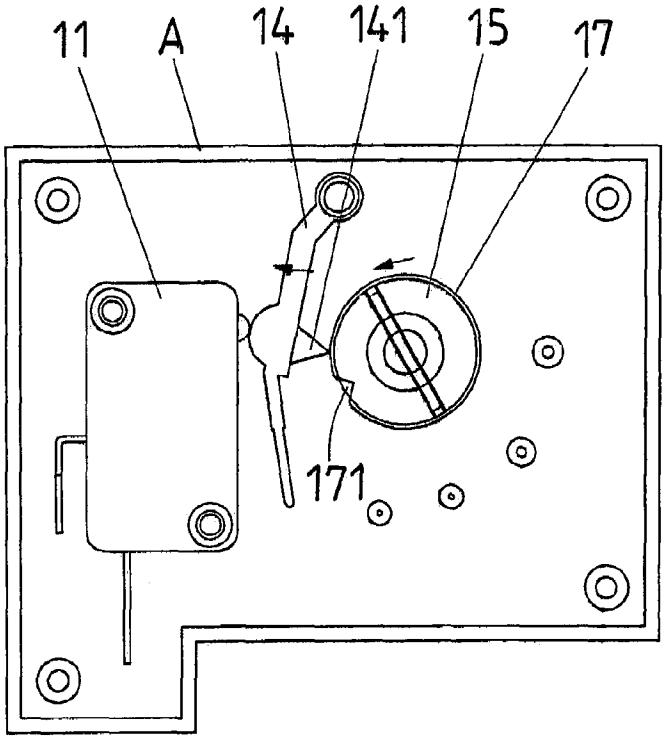
Figure 4:
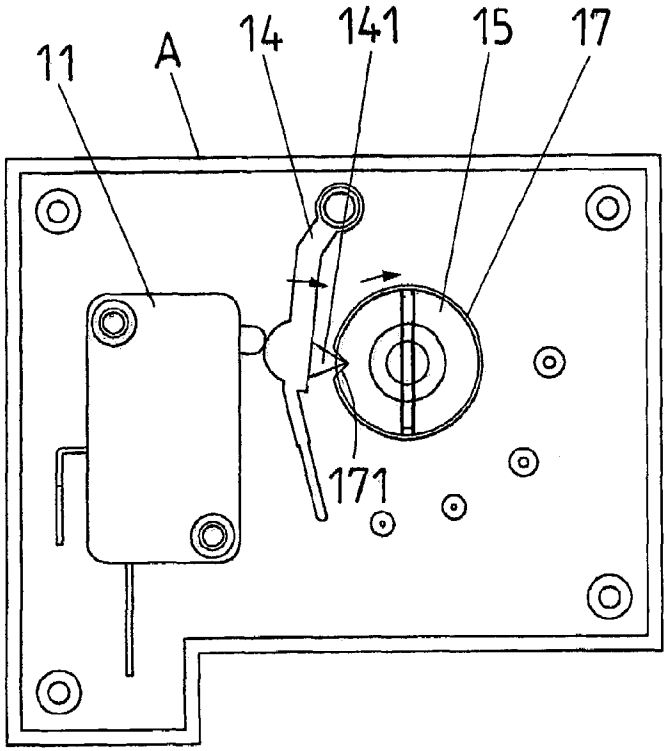
FIG. 4 is a schematic view showing the state that the power of the invention is off.

In an embodiment, the energy storage device 12 is a spiral spring connected with the variable gear set 13. During the operation of the cutting blade ensemble 20, the energy storage device 12 (i.e., the sprial spring) is driven concurrently by the cutting blade ensemble 20 to store energy. With reference to FIGS. 4 and 5, the knob 15 and a dial 17 are connected with the output axis of the variable gear set 13. The edge of the dial 17 has a notch 171. The trigger 14 has a hook 141 corresponding to the notch 171. When the cutting blade ensemble stops its operation, the energy storage device (spiral spring) moves inversely to drive the variable gear set into operation. When the variable gear set rotates to a certain extent, the dial 17 rotates to a position where the hook 141 of the trigger 14 falls right into the notch 171. In this case, the breaker switch 11 breaks the electrical power of the shredder, achieving the effects of saving energy and providing protection.

When one turns the knob 15 to rotate the dial 17, the hook 141 of the trigger 14 retreats from the notch 171 of the dial 17, thereby restoring the trigger 14. The electrical power of the shredder is turned on again to start its normal operation. The electricity breaker also resumes its auto electricity breaker function.

It should be mentioned that the disclosed energy storage device establishes transmission with the cutting blade ensemble via a one-way mechanism, as shown in FIG. 1. The one-way mechanism 16 includes: a first fixed frictional wheel 161 disposed in the energy storage device 12 and establishing transmission with it, a second fixed frictional wheel 165 disposed in the cutting blade ensemble 20 and establishing transmission with it, a gloating frictional wheel 162 disposed between the first and second fixed frictional wheels 161, 165, a groove 163 for the floating frictional wheel 162 to move relative to the first and second fixed frictional wheels 161, 165, and an elastic element 164 that pushes the floating frictional wheel 162 toward the first and second fixed frictional wheels 161, 165.

Figure 7:
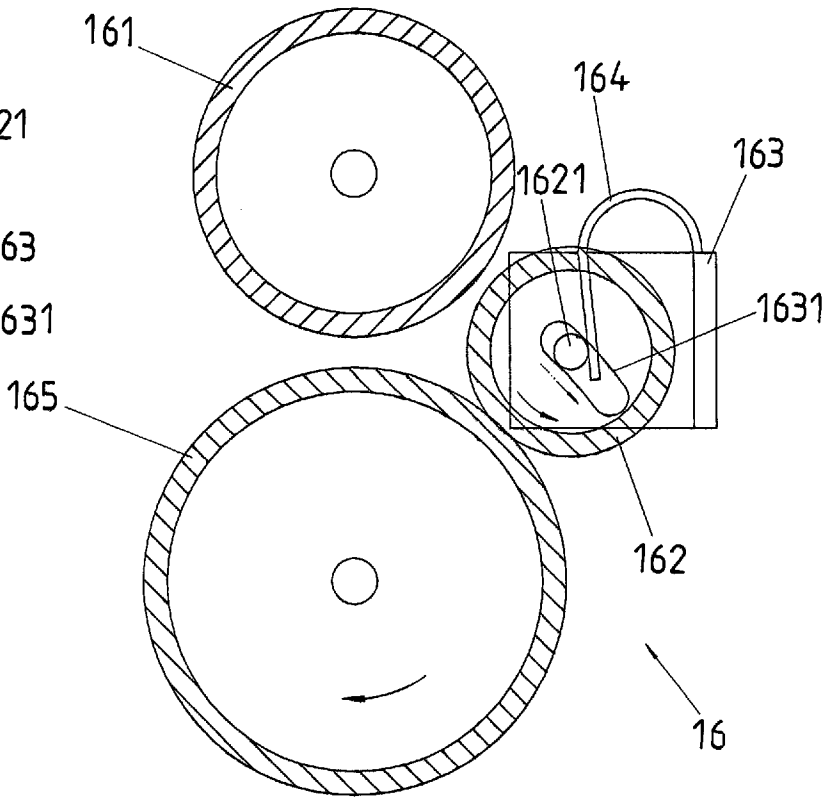
FIG. 7 is a schematic view showing the disclosed one-way mechanism in a transmissions state.
Figure 6:
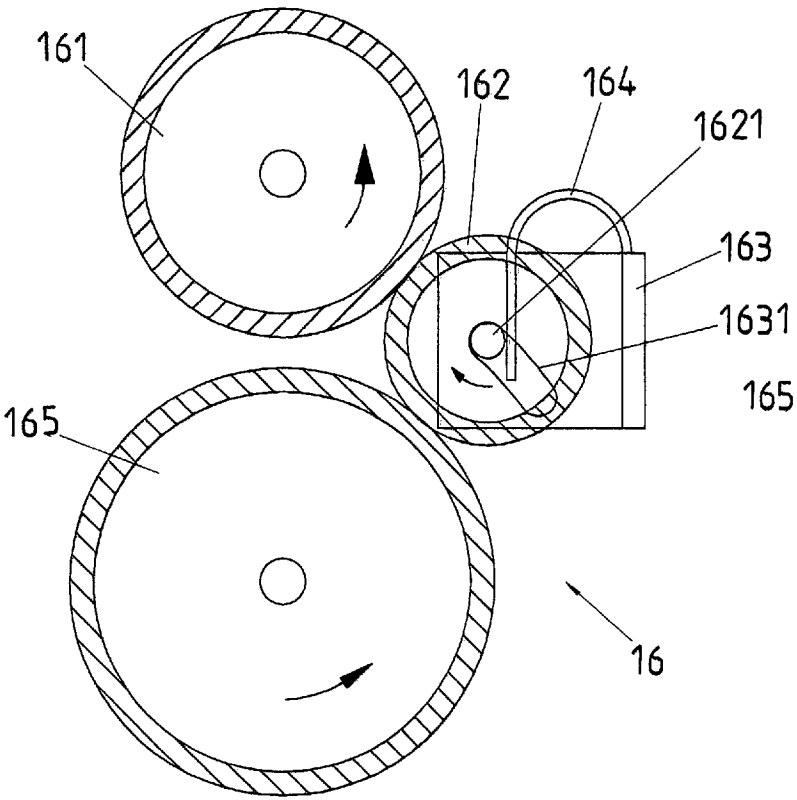
FIG. 6 is a schematic view showing the disclosed one-way mechanism in a transmissions state.

The axis of the second fixed frictional wheel 165 is provided with a first transmission gear 1651. The first transmission gear forms a transmission connection with a primary gear 21 at the rotary shaft of the cutting blade ensemble 20 via a second transmission gear 22. As shown in FIGS. 6 and 7, the groove 163 has an arc groove 1631 along the cruved arc of the second fixed frictional wheel 165. The axis 1621 of the floating frictional wheel 162 goes into the arc groove 1631 of the groove 163. When the cutting blade ensemble rotates in the forward direction, the floating frictional wheel 162 ensures the transmission between the first and second fixed frictional wheels 161, 165. The energy storage device is driven by the cutting blade ensemble to store energy. When the cutting blade ensemble rotates backward, the floating frictional wheel 162 departs from one of the first fixed frictional wheel 161, so that there is no transmission between the two fixed frictional wheels 161. In this case, the energy storage device does not operate with the cutting blade ensemble. This prevents the energy storage device from releasing energy in an abnormal way. The electricity breaker indeed has the function of automatically breaking the electricity.

Figure 8:
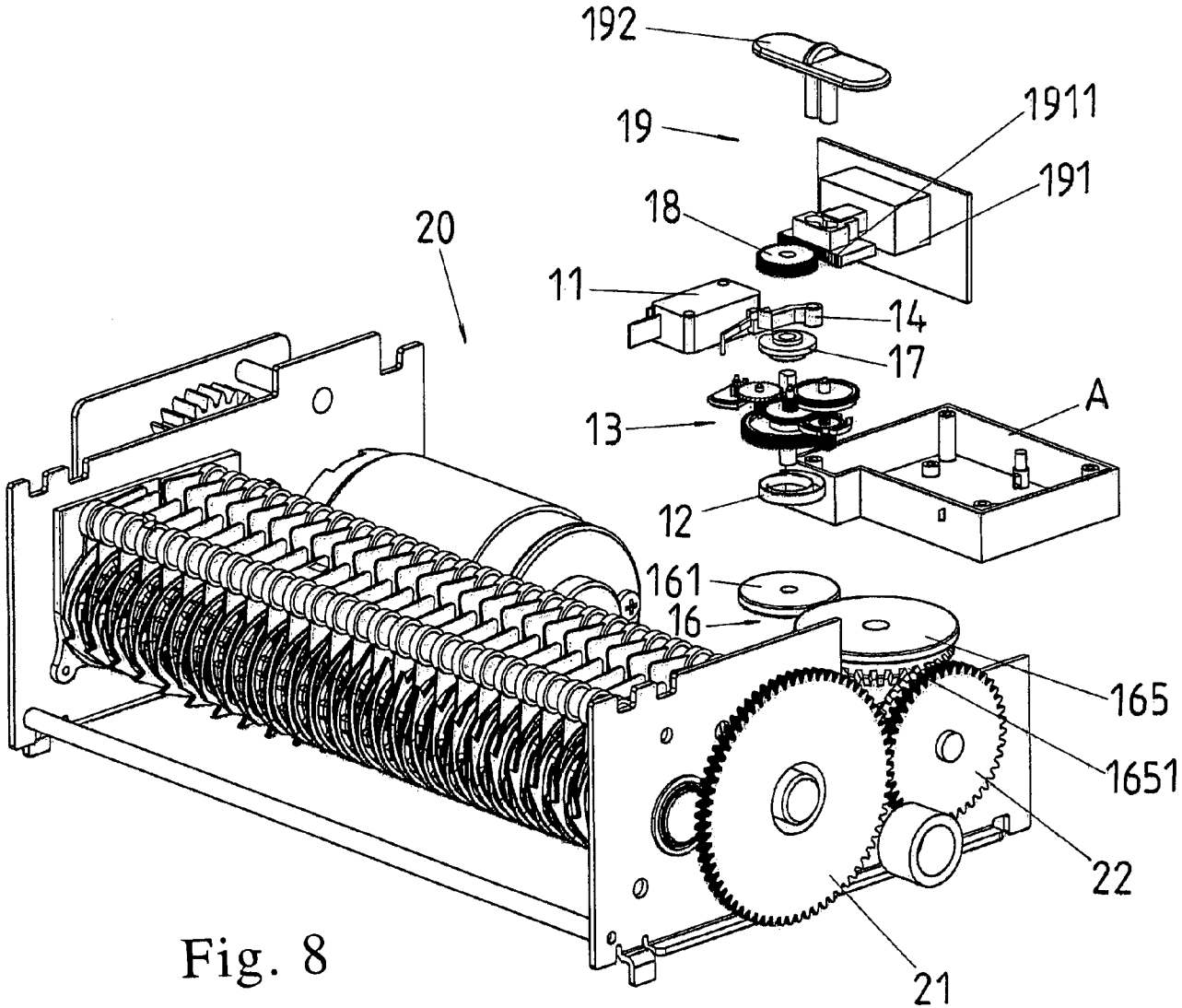
FIG. 8 is an exploded view of the auto electricity breaker according to the second embodiment of the invention.
Figure 11:
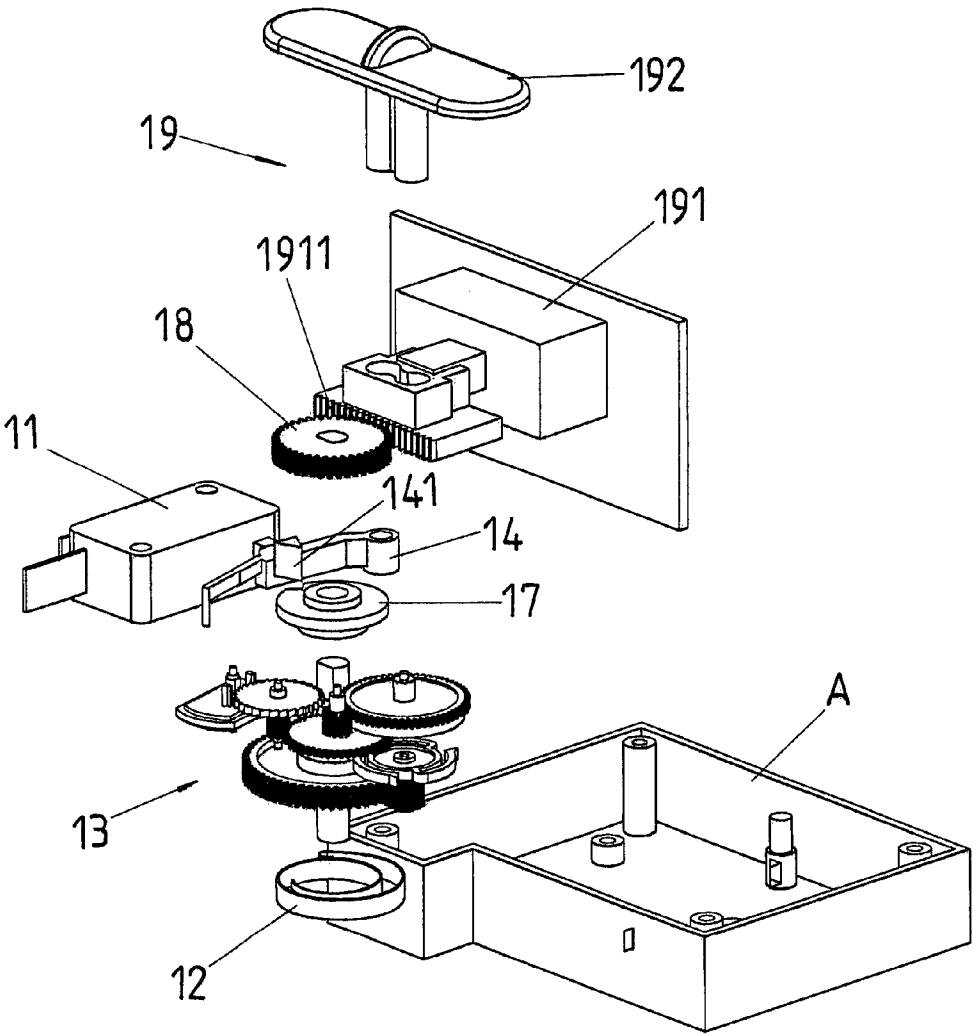
FIG. 11 is an exploded view of the variable gear set, the energy storage device, and the switch ensemble in the second embodiment.

Besides, the starting switch composed of the knob 15 in the above embodiment can be replaced by the push switch 192 in FIG. 8. The push switch 192 can be integrated with the switch ensemble 19 of the shredder. As shown in FIGS. 8 and 11, the push switch 192 is integrated with the slide switch 191 of the shredder into a switch ensemble 19. The transmission between the energy storage device and the cutting blade ensemble is achieved by a first fixed frictional wheel 161 disposed at the energy storage device 12 for transmission and a second fixed frictional wheel 165 disposed at the cutting blade ensemble 20 for transmission.

Figure 9:
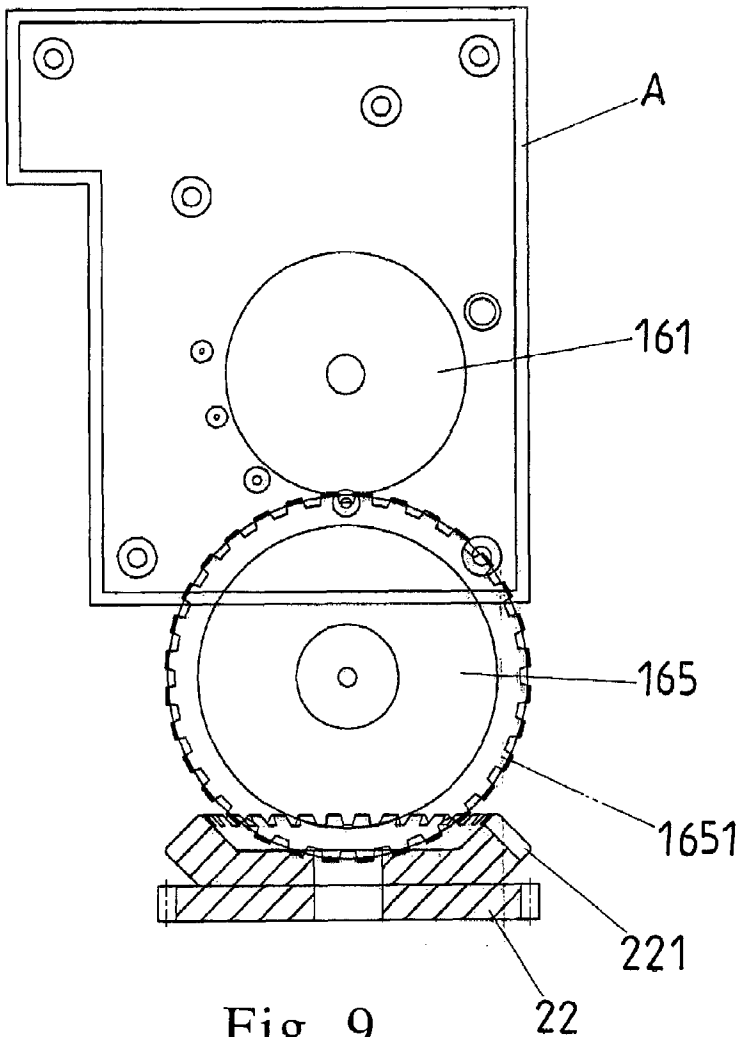
FIG. 9 is a schematic front view showing the transmission of the first and second fixed frictional wheels according to the second embodiment.
Figure 10:
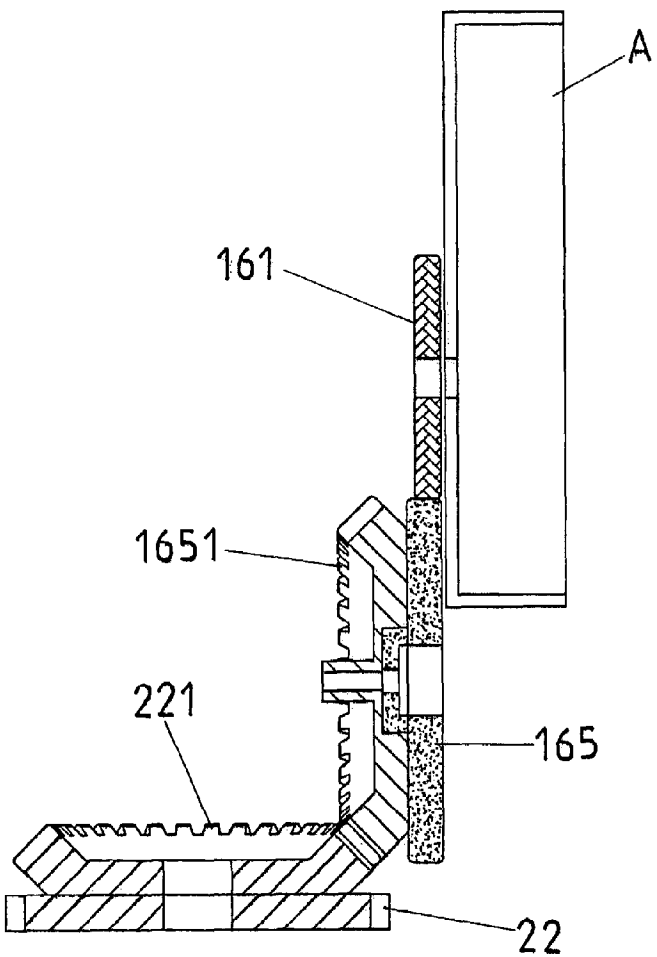
FIG. 10 is a schematic side view showing the transmission of the first and second fixed frictional wheels according to the second embodiment.

Please refer to FIGS. 8, 9, and 10 simultaneously. The axis of the second fixed frictional wheel 165 is provided with a first transmission gear 1651. The first transmission gear forms a transmission connection with a primary gear 21 at the rotary shaft of the cutting blade ensemble 20 via a second transmission gear 22 that has an inner gear 221. When the cutting blade ensemble rotates forward, the energy storage device is driven by the cutting blade ensemble to store energy through the transmission of the first and second fixed frictional wheels 161, 165.

Figure 13:
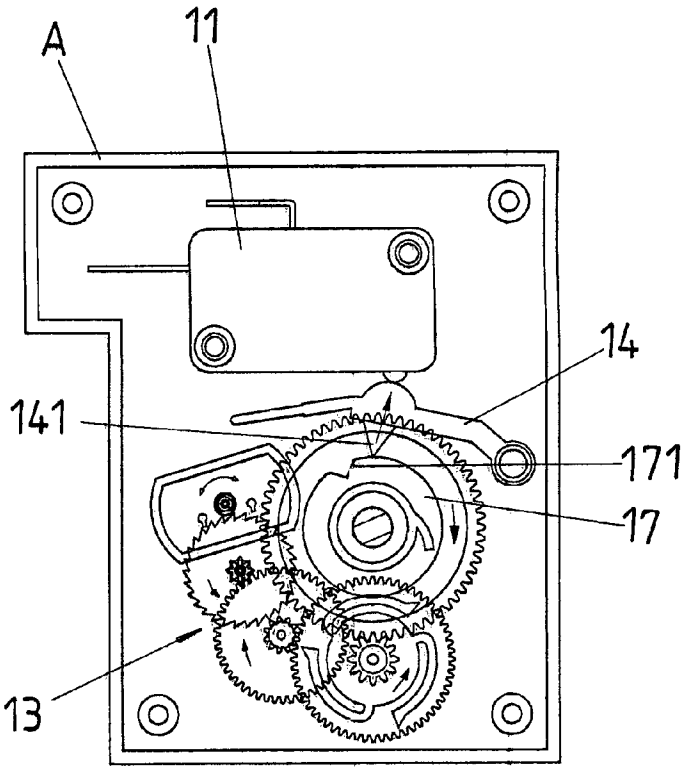
FIG. 13 schematically shows the action of the trigger in the second embodiment.
Figure 12:
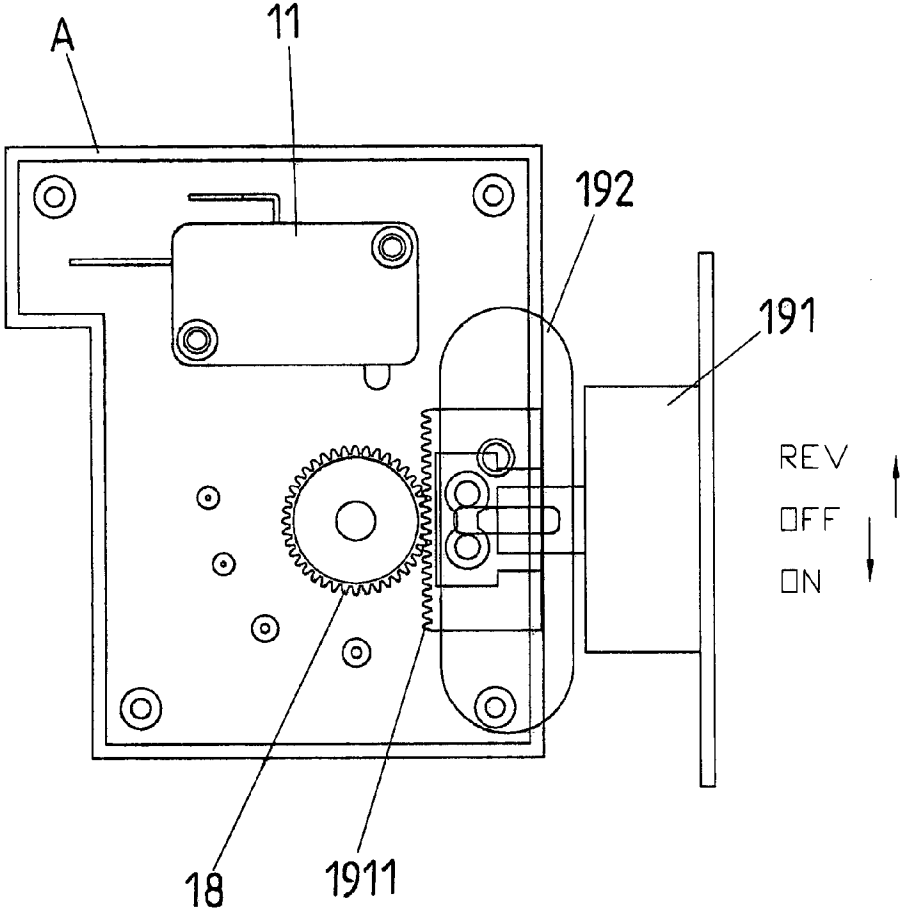
FIG. 12 is a schematic view showing the transmission of the push switch and the third transmission gear in the second embodiment.

As shown in FIGS. 8, 12, and 13, the push switch 192 forms transmission with a third transmission gear 18 between the dial 17 and the variable gear set 13 via a saw bar 1911. The edge of the dial 17 is formed with a notch 171. The trigger 14 has a hook 141 corresponding to the notch 171. When the cutting blade ensemble stops operation, the energy storage device (spiral spring) moves backward and drives the variable gear set. Once the variable gear set operates to a certain extent, the dial 17 rotates to a position so that the hook 141 of the trigger 14 falls into the notch 171. The electricity breaker 11 thus breaks the power to the shredder, achieving the goals of saving energy and providing protection.

The user can push the push switch 192 to rotate the dial 17, backing the hook 141 of the trigger 14 out of the notch 171 of the dial 17. This restores the trigger 14 to its original position. The power of the shredder is turned on again for normal operation. The electricity breaker also resumes its auto electricity breaker function.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An auto electricity breaker for a shredder, comprising:

a base;

a breaker switch for controlling the electrical power to the shredder;

an energy storage device driven by a cutting blade ensemble of the shredder to store energy;

a variable gear set driven by the energy released from the energy storage device;

a trigger driven by the variable gear set to trigger the breaker switch; and a starting switch for restoring the trigger;

wherein the energy storage device releases its stored energy when the cutting blade ensemble stops its operation and drives the variable gear set into operation; the variable gear set drives the trigger when it rotates to a certain extent; the trigger releases the breaker switch to break the electrical power to the shredder; and when the electrical power of the shredder is turned on again, the starting switch restores the trigger to its original position so that the shredder starts its normal operation and the electricity breaker resumes its auto electricity breaking function.

2. The auto electricity breaker for a shredder of claim 1, wherein the energy storage device comprises a spiral spring connected with the variable gear set.

3. The auto electricity breaker for a shredder of claim 1, wherein the starting switch is a knob in connection with a dial and an output axis of the variable gear set, the edge of the dial has a notch, and the trigger has a hook corresponding to the notch.

4. The auto electricity breaker for a shredder of claim 1, wherein the energy storage device forms transmission with the cutting blade ensemble via a one-way mechanism.

5. The auto electricity breaker for a shredder of claim 1, wherein the one-way mechanism further includes:

a first fixed frictional wheel fixed at the energy storage device for transmission;

a second fixed frictional wheel fixed at the cutting blade ensemble for transmission;

a floating frictional wheel disposed between the two fixed frictional wheels;

a groove for the floating frictional wheel to move relative to the two fixed frictional wheel; and an elastic element for pushing the floating frictional wheel toward the two fixed wheels.

6. The auto electricity breaker for a shredder of claim 5, wherein the axis of the second fixed frictional wheel is provided with a first transmission gear, the first transmission gear forms transmission with a primary gear at the axis of the cutting blade ensemble via a second transmission gear that has an inner gear, the groove has an arc groove along the curved arc of the second fixed frictional wheel, and the axis of the floating frictional wheel goes into the arc groove of the groove.

7. The auto electricity breaker for a shredder of claim 1, wherein the starting switch is a push switch that forms transmission with a third transmission gear that connects a dial and an output axis of the variable gear set via a saw bar, the edge of the dial is formed with a notch, and the trigger has a hook corresponding to the notch.

8. The auto electricity breaker for a shredder of claim 7, wherein the transmission between the energy storage device and the cutting blade ensemble is achieved by a first fixed frictional wheel disposed at the energy storage device for transmission and a second fixed frictional wheel disposed at the cutting blade ensemble for transmission, the axis of the second fixed frictional wheel is provided with a first transmission gear, and the first transmission gear forms transmission with a primary gear at the axis of the cutting blade ensemble via a second transmission gear.

* * * * *